United States Patent [19]

Jacobs

[11] 4,155,546

[45] May 22, 1979

[54] BOTTOM SHEET FEEDING APPARATUS

[75] Inventor: Robert D. Jacobs, Geneseo, N.Y.

[73] Assignee: Itek Corporation, Lexington, Mass.

[21] Appl. No.: 819,208

[22] Filed: Jul. 27, 1977

[51] Int. Cl.[2] ..... B65H 1/06; B65H 3/08

[52] U.S. Cl. ..... 271/11; 271/3.1; 271/100; 271/160; 271/165

[58] Field of Search ..... 271/99, 100, 101, 102, 271/165, 160, 166, 11, 12, 13, 14, 15, 132, 20, 23, 35, 126, 3.1; 214/8.5 P

[56] References Cited

U.S. PATENT DOCUMENTS

| | | | |
|---|---|---|---|
| 1,388,678 | 8/1921 | Weightman et al. | 271/100 |
| 3,424,452 | 1/1969 | Jones | 271/100 |
| 3,934,868 | 1/1976 | Selak | 271/100 X |
| 4,053,152 | 10/1977 | Matsumoto | 271/118 X |

FOREIGN PATENT DOCUMENTS

| | | | |
|---|---|---|---|
| 675911 | 7/1952 | United Kingdom | 271/35 |

*Primary Examiner*—Bruce H. Stoner, Jr.

*Attorney, Agent, or Firm*—Homer O. Blair; Robert L. Nathans; Gerald H. Glanzman

[57] ABSTRACT

Apparatus for feeding sheets one-at-a-time from the bottom of a stack of sheets. The apparatus includes a conventional suction assembly moveable into contact with the bottom sheet in the stack to attach itself to that sheet, and thereafter moveable away from the stack to carry that sheet toward a utilization device. Although such a feeding system is usually effective, it has been found that the suction assembly will not reliably attach itself to the bottom sheet when that sheet is curled, arched or otherwise deformed even if only to a relatively minor extent. To alleviate this deficiency, the present invention provides a hold-down assembly moveable with the suction assembly to press down against the top of the stack to press out any deformations in the sheets while the suction assembly is operating to ensure that it will reliably attach itself to the bottom sheet. The present invention is particularly designed for use in printing systems to transfer a printing plate from a platemaking section to a printing press section of the system although the invention has general application in a variety of other fields.

15 Claims, 3 Drawing Figures

BOTTOM SHEET FEEDING APPARATUS

BACKGROUND OF THE INVENTION

1. Field of the Invention

The present invention relates generally to the field of sheet feeding apparatus, and, more particularly, to a vacuum feeding apparatus for feeding printing plates one-at-a-time from the bottom of a stack of plates to a printing press.

2. Description of the Prior Art

Bottom feeding from a vertical stack of sheets by means of a movable suction device is well known in the prior art (see, for example, U.S. Pat. No. 3,934,868 to Selak and the patents cited therein). Typically, these feeding systems employ a suction cup coupled to a suitable vacuum source and moveable into contact with the bottom face of the lowermost sheet in the stack for the purpose of attaching itself to the sheet, pulling it downwardly and then depositing it on a transfer means for delivery to a utilization device.

Although suction systems such as these are generally effective in feeding sheets one-at-a-time from the bottom of a stack, they do suffer from one particularly significant deficiency. Specifically, for them to operate effectively it is necessary that the sheet to be picked up lie quite flat so that the rim of the suction cup can properly seal against it so as to enable an adequate suction to be established and maintained to hold the sheet and carry it from the bottom of the stack to the transfer means. If the sheet is even slightly curled or arched or otherwise deformed, the suction cup will not be able to properly seal against it and jamming will occur necessitating operator intervention.

In multiple-stage automated systems employing the sheet feeder, for example, in an automated printing system, reliability is obviously very important. Accordingly, a sheet feeding system which will operate with improved reliability and with a minimum need for operator intervention would be a significant advance in the art.

SUMMARY OF THE PREFERRED EMBODIMENT

In accordance with the present invention, a bottom sheet feeding apparatus is provided which significantly alleviates the prior art inadequacies described above. According to the presently most preferred embodiment of the invention, apparatus for feeding printing plates one-at-a-time from the bottom of a stack of plates is provided which, as in the prior art, also employs a suction cup to grab and remove the bottom plate. However, unlike the prior art, the present invention additionally provides structure to ensure that the suction cup will attach itself to and remove the plate with much improved reliability.

According to the preferred embodiment, this structure comprises a hold-down assembly adapted to press down against the top of the stack of plates to flatten them out. Furthermore, the operation of the hold-down plate is controlled by a crank assembly which moves the plate against the top of the stack simultaneously with the movement of the suction cup toward the bottom of the stack, and which automatically lifts the plate away from the stack during other periods to permit new printing plates to be added to the stack.

Although relatively simple in design, the present invention is effective in ensuring that the suction cup will reliably attach itself to and remove the bottom plate from the stack. Furthermore, the invention will ensure reliable operation irrespective of the number of plates in the stack. Many prior art systems are particularly susceptible to jamming when only a few plates are in the stack.

Further features of the invention will be set out in greater detail hereinafter.

DETAILED DESCRIPTION OF THE PREFERRED EMBODIMENT

Figure 1:
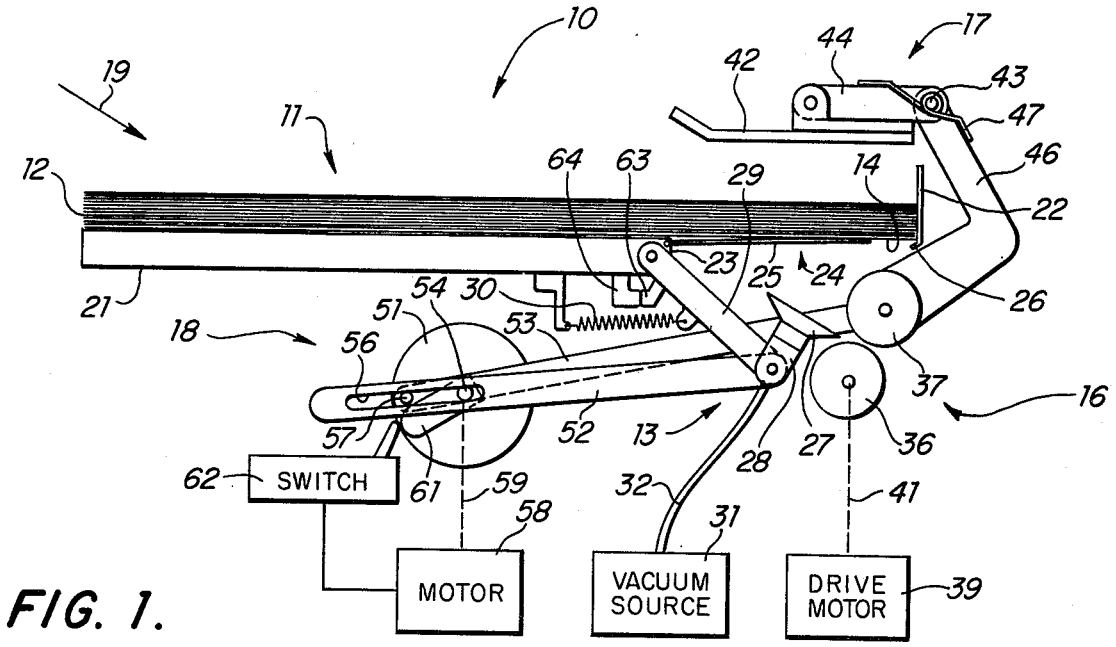
FIG. 1 schematically illustrates, a sheet feeding apparatus according to the presently most preferred embodiment of the invention in a stand-by position.
Figure 2:
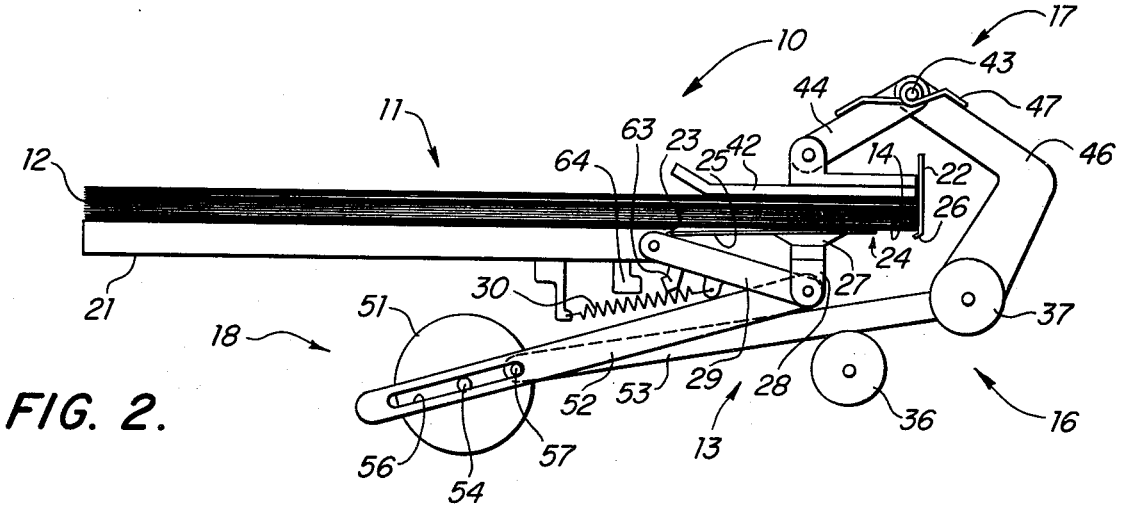
FIG. 2 schematically illustrates the apparatus of FIG. 1 in a sheet pick-up position.
Figure 3:
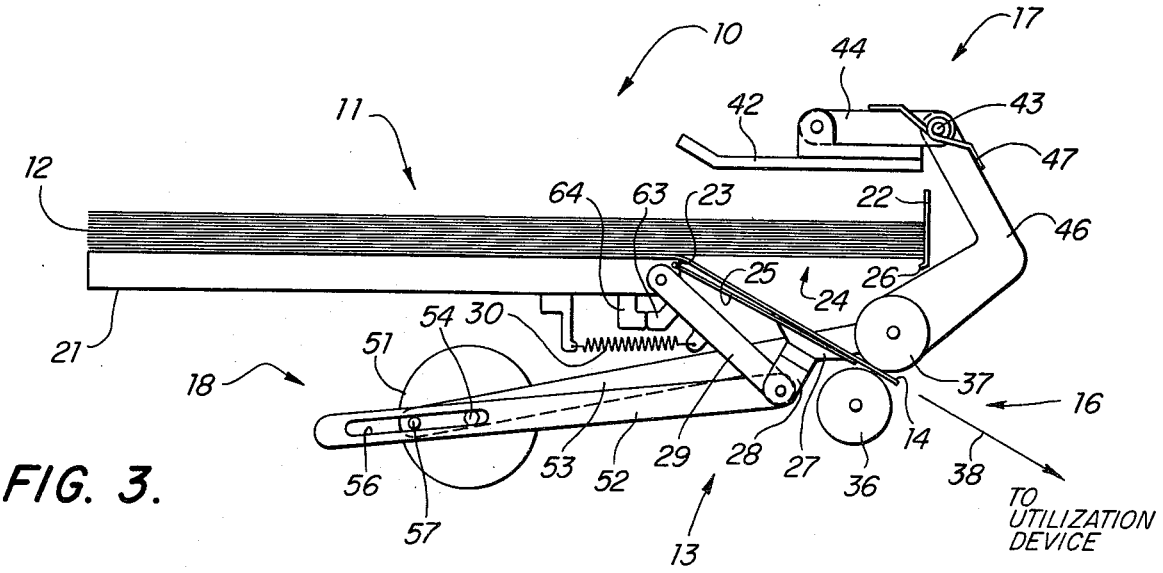
FIG. 3 schematically illustrates the apparatus of FIG. 1 in a sheet transport position.

FIGS. 1–3 schematically illustrate the sheet feeding apparatus according to the present invention in stand-by, sheet pick-up and sheet transport positions, respectively. Although this apparatus can readily be employed in a wide variety of sheet feeding applications, it has been specifically developed for use in printing systems for transferring a printing plate from the platemaker portion to the printing press portion of the system. Accordingly, although the invention will be described hereinafter within that environment, it should be understood that it is not intended to be limited to that particular application.

With reference now to the FIGS. the feeding apparatus, generally designated by reference number 10, includes a receiving bin assembly 11 for receiving and supporting a stack of printing plates 12, a suction assembly 13 for grabbing and removing the bottom plate 14 from the stack 12, a transfer assembly 16 for transferring the plate to a utilization device, i.e., a printing press (not shown), a hold-down assembly 17 for pressing down against the top of the stack of plates to ensure proper action of the suction assembly, and a drive assembly 18 to drive and control the positions of the suction, transfer and hold-down assemblies for proper operation.

Receiving bin assembly 11 is provided to receive and hold a stack of printing plates 12 until they are ready for use by the printing press. These plates may be placed into bin 11 by hand, but, preferably, they are placed into the bin from the direction indicated by arrow 19 by a suitable feed mechanism (not shown).

Receiving bin assembly 11 comprises a base 21 for supporting the stack of plates, a front wall 22 and, preferably, side walls as well although these have not been illustrated in the FIGS. for reasons of clarity. Front wall 22 is spaced from the end 23 of base 21 by a distance of 3 or 4 inches to define a space or opening 24. As shown in the FIGS., the stack of plates are supported beyond the edge 23 of the base up to or against front wall 22 by flexible extensions 25 so that the suction assembly 13 may extend through opening 24 and between the extensions to pick-up the printing plates.

Front wall 22 is provided with a small fixed lip or finger element 26 as shown to help support the plates horizontally in the receiving bin and also to assist in separating the bottom plate 14 from the rest of the stack 12 when it is being removed by the suction assembly. The receiving bin itself may be designed to hold fifty or more plates at a time.

The removal of printing plates, one-at-a-time, from the bottom of stack 12 is performed by suction assembly 13. Assembly 13 includes a suction cup 27 supported by a stem 28. Stem 28 is pivotally supported by linkage 29 which, in turn, is pivotally coupled to base 21. A spring assembly 30 coupling linkage 29 is also provided to help control movement of the suction assembly as will be explained hereinafter. Also, an element 63 attached to linkage 29 is provided to cooperate with stop 64 attached to base 21 to limit backward movement of assembly 13.

The suction cup is of conventional type and consists of a flexible rubber cup having an outside diameter of about ¾ inch. Stem 28 is provided with an opening (not shown) coupling the interior of the suction cup to a suitable vacuum source 31 via flexible coupling 32 (illustrated in FIG. 1 only for purposes of clarity).

The suction assembly 13 is adapted to be moved sequentially from the stand-by position of FIG. 1 to the plate pick-up position of FIG. 2, to the plate transport position of FIG. 3 by drive assembly 18 and spring assembly 30 which will be described in greater detail hereinafter.

Also illustrated in the FIGS. is a transfer assembly 16 to transfer the printing plate 14 removed from the stack by suction assembly 13 to the printing press or other utilization device (not shown). Transfer assembly 16 comprises a roller 36 and a wheel assembly 37 adapted to feed the plate therebetween to the printing press in the direction indicated by arrow 38 (FIG. 3). Roller 36 comprises a drive roller and is driven into rotation by motor 39 via mechanical coupling 41 (FIG. 1), while feed-out wheel assembly 37 is coupled to drive assembly 18 for movement toward and away from drive roller 36 as will be described hereinafter.

In order to ensure that the suction assembly 13 will reliably attach itself to bottom printing plate 14, a hold-down assembly 17 is provided. Hold-down assembly 17 comprises a hold-down plate 42 having a length approximately equal to the length of spacing 24. Hold-down plate 42 is pivotally supported on a stationary support rod 43 by a linkage member 44.

As shown in the FIGS., stationary rod 43 also pivotally supports a second linkage 46 which is coupled to feed-out wheel assembly 37, and a torsion spring 47 is wound around rod 43 and presses against the two linkages 44 and 46. Accordingly, when wheel assembly 37 is moved from the FIG. 1 position to the FIG. 2 position, by drive assembly 18, hold-down plate 42 will simultaneously be moved downwardly into contact with the stack of plates 12 by the action of torsion spring 47 as will be explained hereinafter.

The suction assembly 13, the transport assembly 16 and the hold-down assembly 17 are all adapted to be moved in synchronism by drive assembly 18. Drive assembly 18 comprises a rotatable crank assembly 51 having a pair of crank arms 52 and 53. Arm 52 is coupled to the suction assembly 13 while arm 53 is coupled to feed-out wheel assembly 37. Specifically, as can be seen in the FIGS., arm 52 is provided with an elongated slot 56 within which crank pin 57 is adapted to ride. In addition, crank pin 57 is coupled to arm 53 as illustrated such that rotation of crank 51 about its axis 54 will carry pin 57 and hence arms 52 and 53 back and forth. Crank 51 is driven into rotation by motor 58 through mechanical coupling 59 (FIG. 1). A cam surface 61 is rigidly coupled to axial shaft 54 to cooperate with a switch 62. The switch 62 is electrically coupled to motor 58 and is actuated by cam surface 61 to control the one-rotation drive of the crank assembly.

The system described above operates as follows. FIG. 1 illustrates the system in a stand-by position. As can be seen, the vacuum assembly 13 is down from the stack of plates 12 while the hold-down assembly 17 is up and out of the way so that printing plates may be fed into bin 11 as indicated by arrow 19. Also, roller 36 and wheel assembly 37 are together. When it is desired to pick-up and feed the bottom plate 14 from the stack 12, the vacuum source 31 is actuated to introduce a suction in the suction cup. Also, motor 58 is actuated to rotate crank assembly 15 (this all may be done manually by pressing a button or automatically). Rotation of crank 51 will cause crank arm 52 to push suction cup 27 against bottom plate 14 while, simultaneously, crank arm 53 will push feed-out wheel assembly 37 away from drive roller 36. The movement of wheel assembly 37 will, in turn, cause hold-down plate 42 to move down via linkages 46 and 44 and torsion spring 47 to press down against the top of stack 12. When the elements are in this position (FIG. 2), the stack of plates will be somewhat sandwiched between hold-down plate 62 and suction cup 27 and this will tend to flatten out the printing plates and eliminate any curling or arching of the plates. This will help ensure that the rim of suction cup 27 will seal against the plate 14 to allow the suction cup to reliably attach itself to plate 14 in the FIG. 2 position.

Continuing rotation of crank 51 will allow spring assembly 30 to cause suction assembly 13 to swing downward until element 63 attached to linkage 29 comes into contact with stop 64 attached to base 21. This will bring printing plate 14 and the flexible extensions 25 past finger 26 until it rests upon drive roller 36. Simultaneously, wheel assembly 37 will come down against the plate causing hold-down plate to move back up and away from stack 12 and switch 62 will be actuated to stop further movement. In this position, shown in FIG. 3, motor 39 can be actuated to drive plate 14 to the printing press or other utilization device as indicated by arrow 38. This will release flexible extensions 25 to return under stack 12, and the system will then be back in the stand-by position of FIG. 1 until it is time to feed the next plate.

In summary, the present invention provides a bottom sheet feeding apparatus which will operate in a more reliable manner to pick-up a sheet from the bottom of a stack of sheets and feed it to a utilization device. By providing a hold-down plate to press down against the top of the stack while the suction cup presses upwardly against the bottom sheet, any curls or arches in the plates will tend to be flattened out to ensure that the suction cup will properly attach itself to the plate and carry it to the transfer rollers.

Although a presently most preferred embodiment has been described above, it should be understood that the invention could take many other forms. For example, it could be used in many other applications where bottom sheet feeding is desired. Also, the drive means to move the various parts of the system could take many other forms. Because many additions and changes can be made without departing from the present invention, it should be understood that the invention should be limited only insofar as required by the scope of the following claims.

I claim:

1. Sheet feeding apparatus for feeding sheets one-at-a-time from the bottom of a stack of sheets, said apparatus including:

a. means for supporting a stack of sheets;

b. sheet removal means for removing the bottom sheet from said stack of sheets;

c. means for moving said sheet removal means from a first sheet removal means position spaced from said stack of sheets to a second sheet removal means position in contact with said bottom sheet;

d. hold-down means for pressing down upon the top of said stack of sheets;

e. means for moving said hold-down means from a first hold-down means position displaced from the top of said stack of sheets for permitting additional sheets to be added to the top of said stack of sheets, to a second hold-down means position in contact with and pressing down upon the top of said stack of sheets such that the pressure of said hold-down means against the top of said stack of sheets will tend to flatten out said bottom sheet to help insure that said sheet removal means will properly contact said bottom sheet; and f. wherein said means for moving said sheet removal means and said means for moving said hold-down means includes drive means coupled to both said sheet removal means and to said hold-down means for moving said sheet removal means from said first sheet removal means position to said second sheet removal means position while substantially simultaneously moving said hold-down means from said first hold-down means position to said second hold-down means position.

2. Apparatus as recited in claim 1 wherein said drive means further includes means for moving said sheet removal means from said second sheet removal means position to a third sheet removal means position spaced from said stack of sheets for withdrawing said bottom sheet from said stack of sheets.

3. Apparatus as recited in claim 2, wherein said drive means further includes means for moving said hold-down means from said second hold-down means position back to said first hold-down means position substantially simultaneously with the movement of said sheet removal means from said second sheet removal means position to said third sheet removal means position.

4. Apparatus as recited in claim 2 and further including transfer means for receiving said bottom sheet from said sheet removal means when said sheet removal means is in said third sheet removal means position.

5. Apparatus as recited in claim 4 wherein said transfer means comprises a pair of feed means, and wherein said drive means includes means coupled to one of said feed means for moving said one feed means from a first feed means position adjacent said other feed means to a second feed means position spaced from said other feed means, said one feed means being in said second feed means position when said sheet removal means is moved to said third sheet removal means position to permit insertion of said bottom sheet between said pair of feed means and being thereafter moved to said first feed means position for transferring said bottom sheet to a utilization device.

6. Apparatus as recited in claim 5 wherein said one feed means comprises wheel means and wherein said apparatus further includes linkage means coupling said wheel means to said hold-down means whereby movement of said wheel means from said first feed means position to said second feed means position automatically causes said hold-down means to move from said first hold-down means position to said second hold-down means position.

7. Apparatus as recited in claim 6 wherein said other feed means comprises drive roller means.

8. Apparatus as recited in claim 6 wherein said drive means comprises rotatable crank means having crank arm means coupled to said sheet removal means and to said wheel means for moving said sheet removal means and said wheel means, said wheel means, in turn moving said hold-down means by said linkage means.

9. Apparatus as recited in claim 1 wherein said sheet removal means comprises suction means.

10. Apparatus for feeding printing plates one-at-a-time from the bottom of a stack of printing plates comprising:

a. means for supporting a stack of printing plates;

b. bottom plate removal means for removing the bottom plate from said stack of plates;

c. means for moving said bottom plate removal means into contact with said bottom plate for attachment thereto;

d. hold-down means for pressing down upon the top of said stack of plates;

e. means for moving said hold-down means into contact with the top of said stack of plates substantially simultaneously with the movement of said bottom plate removal means into contact with said bottom plate whereby the pressure of said hold-down means against the top of said stack of plates will tend to flatten out said bottom plate to help insure that said bottom plate removal means will properly attach itself to said bottom plate; and f. means for moving said bottom plate removal means and said bottom plate attached thereto to a plate transfer position for transferring said bottom plate to a utilization device, said means for moving said bottom plate removal means and said bottom plate attached thereto to said plate transfer position including means coupled to said hold-down means for moving said hold-down means away from the top of said stack of plates so as to permit additional plates to be added to said stack of plates.

11. Apparatus as recited in claim 10 wherein said hold-down means comprises a hold-down plate.

12. Apparatus as recited in claim 10 wherein said means for moving said bottom plate removal means and said means for moving said hold-down means comprise drive means coupled to both said bottom plate removal means and said hold-down means.

13. Apparatus as recited in claim 12 wherein said drive means comprises rotatable crank means.

14. Apparatus as recited in claim 12 and including transfer means movable to a plate receiving position for receiving said bottom plate when said bottom plate is in said plate transfer position for transferring said plate to said utilization device, said apparatus further including linkage means coupling said transfer means to said plate receiving position by said drive means causing said hold-down means to move into contact with the top of said stack of plates through said linkage means.

15. Apparatus as recited in claim 10 wherein said bottom plate removal means comprises suction means.

* * * * *